United States Patent [19]

Krügener et al.

[11] 4,231,244

[45] Nov. 4, 1980

[54] CYLINDER LOCK, ESPECIALLY FOR MOTOR VEHICLES

[75] Inventors: Rolf Krügener; Hermann W. Kurth, both of Sindelfingen, Fed. Rep. of Germany

[73] Assignee: Daimler-Benz Aktiengesellschaft, Fed. Rep. of Germany

[21] Appl. No.: 952,733

[22] Filed: Oct. 19, 1978

[30] Foreign Application Priority Data

Oct. 28, 1977 [DE] Fed. Rep. of Germany ..... 2748408

[51] Int. Cl.[3] ..... E05B 63/00

[52] U.S. Cl. ..... 70/422; 70/1.5

[58] Field of Search ..... 70/422, 421, 1.5, 1.7

[56] References Cited

U.S. PATENT DOCUMENTS

| | | | |
|---|---|---|---|
| 2,004,434 | 6/1935 | Fitzgerald | 70/1.5 |
| 4,074,547 | 2/1978 | Seidewand | 70/1.5 |

*Primary Examiner*—Robert L. Wolfe

*Attorney, Agent, or Firm*—Craig and Antonelli

[57] ABSTRACT

A cylinder lock, especially for motor vehicles, consisting of a rotor with tumblers, which is operatively connected with locking elements; with a key pulled off in the locking position, the tumblers engage in a tumbler channel provided in the inner wall of a stator receiving the rotor; a cut-in or groove constructed as intentional breaking or rupturing place is provided in the rotor adjoining the last tumbler, as viewed in the key insertion direction, which ruptures when a springily engaging locking action between the rotor and the stator not accessible from the outside has taken place during a forcible pulling out of the rotor.

8 Claims, 6 Drawing Figures

FIG. 1
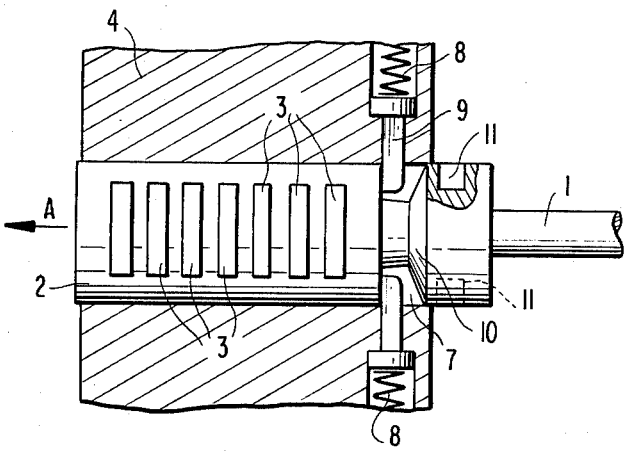
FIG. 3
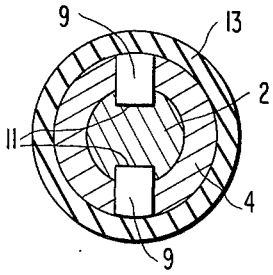
FIG. 2
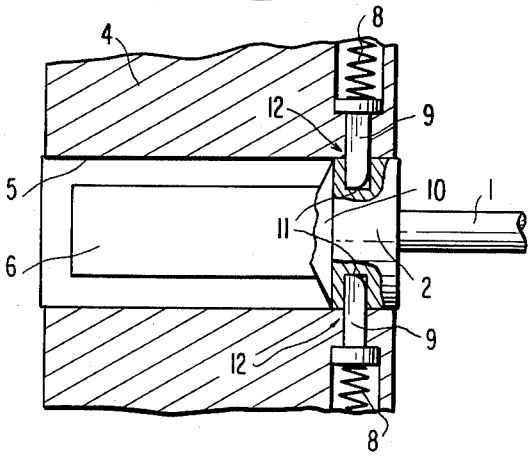
FIG. 4
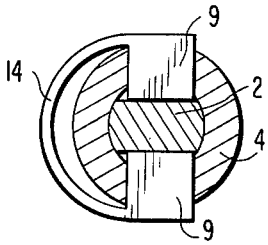
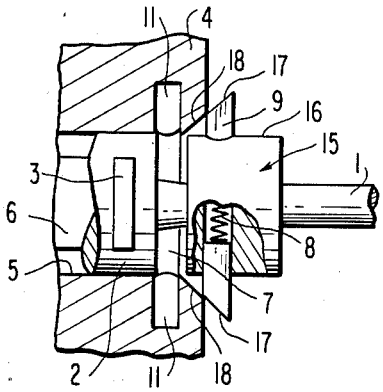
FIG. 5
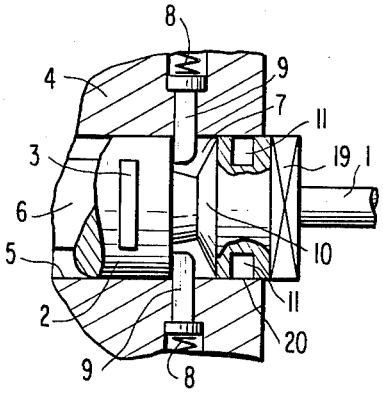
FIG. 6

CYLINDER LOCK, ESPECIALLY FOR MOTOR VEHICLES

The present invention relates to a cylinder lock, especially for motor vehicles, consisting of a rotor in operative engagement with locking elements and having tumblers which with a key pulled off in the locking position engage into at least one tumbler channel that is provided in the interior wall of a stator receiving the rotor.

With forcibly opened doors, hoods and steering locks of motor vehicles, it has been determined by investigations that frequently the rotors were pulled out of the lock housings with the use of an excessively large force application and the then freely exposed locking elements were unlocked by corresponding manipulations. A reinforcement of the lock parts, realized with acceptable expenditures, entails no increased security since very high external forces can be applied at the rotor.

It is the aim of the present invention to provide a possibility to so secure cylinder locks in a simple manner not visible from the outside that even with a forcibly removed rotor, the access to the locking elements is extremely difficult, if not impossible.

Consequently, with a cylinder lock of the aforementioned type, it is proposed that according to the present invention, adjoining the last tumbler—as viewed in the key insertion direction—the rotor includes an intentional breaking or rupturing place formed as cut-in or groove adjoining the last tumbler, which breaks or ruptures when during the forcible pulling out of the rotor, a springily engaging locking that is not accessible from the outside, has taken place between the rotor and the stator. The relatively smooth breakage place which is located recessed in the lock housing offers hardly an application possibility for a tool.

In a preferred embodiment of the present invention, the cut-in or groove in the rotor passes over under formation of inclined butting surfaces for two mutually oppositely disposed, spring-loaded bolts guided in the stator into recesses corresponding in the dimensions to the bolts.

The actuation of the bolts can take place by compression coil springs, by a spring clip connecting the two bolts or by a ring of elastic material.

In another advantageous embodiment of the present invention, a cylindrical section may adjoin the cut-in or groove in the rotor, whereby two mutually oppositely disposed bolts provided with inclined butting surfaces and elastically forced toward the outside, project over the outer surface of this cylindrical section, while inclined entrance surfaces are coordinated on the stator side to the bolts which terminate in recesses.

An additional locking against rotation is achieved in that, adjoining the locking means formed by the bolts and the recesses, the non-removable part of the rotor includes profile sections especially in the form of a polygon which in the course of the displacement of the rotor enters into a correspondingly shaped and constructed area of the stator.

Accordingly, it is an object of the present invention to provide a cylinder lock, especially for motor vehicles, which avoids by simple means the aforementioned shortcomings and drawbacks encountered in the prior art.

Another object of the present invention resides in a cylinder lock, especially for motor vehicles, which assures greater security against break-in of the vehicle by forcible removal of a cylinder lock.

A further object of the present invention resides in a cylinder lock, especially for motor vehicles, which renders extremely difficult, if not altogether impossible, the access to the locking elements even with a forcible removal of the rotor of the cylinder lock of a motor vehicle.

Another object of the present invention resides in a cylinder lock, especially for motor vehicles, which achieves greater security by simple means that are not visible from the outside so that a thief is unaware of the existence of the additional locking means and is also unable to devise an approach to overcome the additional locking action.

These and other objects, features and advantages of the present invention will become more apparent from the following description when taken in connection with the accompanying drawing which shows, for purposes of illustration only, several embodiments in accordance with the present invention, and wherein:

FIG. 1 is a partial longitudinal cross-sectional view of a first embodiment of a cylinder lock in accordance with the present invention with its rotor in the locking position;

FIG. 2 is a partial longitudinal cross-sectional view, similar to FIG. 1, illustrating the parts thereof after a forcible removal of the rotor of the cylinder lock;

FIGS. 3 and 4 are transverse cross-sectional views illustrating two possibilities in accordance with the present invention for the elastic abutment of bolts guided on the side of the stator;

FIG. 5 is a partial longitudinal cross-sectional view through a second embodiment of a cylinder lock in accordance with the present invention with bolts guided in the rotor; and FIG. 6 is a partial longitudinal cross-sectional view through a still further embodiment of a cylinder lock in accordance with the present invention with an additional locking means against rotation in case of a forcibly removed rotor.

Referring now to the drawing wherein like reference numerals are used throughout the various views to designate like parts, a lock cylinder with a number of tumblers 3, which is operatively connected by way of an indicated linkage 1 with locking elements (not shown), is constructed as rotor 2 and is adapted to be inserted both from the outside as also from the inside; after the insertion of a fitting key, the lock cylinder 2 is rotatable in a stator 4, which represents a part of a lock housing (not shown). When pulling out the key in the locking position, the tumblers 3 engage into two mutually oppositely disposed tumbler channels 6 machined into the inner wall 5 of the stator 4 and therewith secure and lock the closed door or closed lid against unauthorized opening.

Adjoining the last tumbler 3, as viewed in the key insertion direction, the rotor 2 is provided with a cut-in or groove 7 constructed as intentional breaking or rupturing place, whereby bolts 9 spring-loaded by coil compression springs 8 and supported in the stator 4 are adapted to engage with the cut-in or groove 7. The cut-in or groove 7 passes over into recesses 11 under formation of an inclined butting surface 10 (FIGS. 1 and 2) for the two bolts 9, which recesses 11 are so dimensioned that they are able to receive the bolts 9. This takes place when—as illustrated in FIG. 1—the rotor 2 disposed in the locking position is pulled in the direction of the arrow "A" by the forcible application of an external force, whereby the rotor 2 moves out of the stator 4 and simultaneously therewith the bolts 9 run up the inclined surfaces 10, deflect elastically and then during a further pulling out of the rotor 2 engage in the now facing recesses 11, as a result of which a locking means generally designated by reference numeral 12 is achieved which secures the thus retained part of the rotor 2 against displacement and rotation.

If now the pull-out force is further increased, then the rotor 2 breaks off at the cut-in or groove 7, as is illustrated in FIG. 2. The relatively smooth breakage or rupture surface hardly offers an application possibility for a tool so that the locking parts (not shown) are far-reachingly protected against an actuation by the securing and safeguarding effect of the bolts 9.

In lieu of the abutment effect for the bolts 9 caused by the coil compression springs 8 illustrated in FIGS. 1, 2 and 6, this abutment force can also be achieved according to FIG. 3 by a ring 13 of elastic material or also—as shown in FIG. 4—by a spring clip 14 connecting the two bolts 9 with each other.

In the embodiment according to FIG. 5, the arrangement of the bolts 9 and of the recesses 11 is reversed as compared to the other embodiments. A cylinder section 15 thereby adjoins the cut-in or groove 7 in the rotor 2, whereby the two mutually oppositely disposed bolts 9 provided with inclined butting surfaces 17 project beyond the outer surface of the cylinder section 15; the bolts 9 thereby run up along the inclined surfaces 18 of the stator 4 prior to their engagement in the recesses 11. In order that the two bolts 9 which are forced outwardly by the coil compression springs 8 cannot fall out, they are secured in a conventional manner (not shown).

The non-removable part of the rotor 2 according to FIG. 6 includes a profile section in the form of a polygon 19 which in the course of the pulling out of the rotor 2 enters into a correspondingly constructed area 20 of the stator 4, not shown in detail, and therewith effects an additional locking against rotation of the remaining rotor 2.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A cylinder lock, comprising rotor means having tumbler means which engage into at least one tumbler channel means provided in the inner wall of a stator means receiving the rotor means, when a key is pulled off in the locking position, said rotor means being operable to be connected with at least one locking element, characterized in that the rotor means is provided with an intentional rupturing place adjoining the last tumbler means, as viewed in the key insertion direction, which ruptures during a forcible pulling out of the rotor means, whereby an elastically engaging locking not accessible from the outside takes place between the rotor and stator means, characterized in that said elastically engaging locking is facilitated through the use of resiliently engaging locking means comprising at least one guided bolt means which, when the rotor is pulled out, initially contacts an inlet bevel, then yields resiliently, and finally engages an associated recess.

2. A cylinder lock according to claim 1, characterized in that the cylinder lock is for motor vehicles.

3. A cylinder lock according to claim 1, characterized in that the intentional rupturing place is constructed as a circumferentially extending cut-in.

4. A cylinder lock according to claim 1, characterized in that the intentional rupturing place in the rotor means is formed proximate to said inlet bevel and said associated recess is positioned in said stator means.

5. A cylinder lock according to claim 4, characterized in that said at least one bolt means is spring-loaded by one of coil compression springs, spring clip means connecting the two bolt means or a ring of elastic material.

6. A cylinder lock according to claim 4, characterized in that a cylinder section adjoins the intentional rupturing place in the rotor means, said cylinder section having said at least one bolt means positioned therein and being elastically forced in the outward direction projecting beyond the outer surface of said cylinder section, whereby an inclined butting surface is coordinated to said at least one bolt means on the stator side which terminates in an associated recess.

7. A cylinder lock according to claim 4, 5 or 6, characterized in that proximate the locking means formed by said at least one bolt means and said associated recess, the non-removable part of the rotor means includes a profile section which in the course of the displacement of the rotor engages in a correspondingly constructed area of the stator means.

8. A cylinder lock according to claim 7, characterized in that the profile section is in the shape of a polygon.

* * * * *